United States Patent [19]

Smith

[11] 4,107,964

[45] Aug. 22, 1978

[54] DEVICE FOR CRIMPING TUBULAR ELEMENTS

[75] Inventor: John Lionel Smith, Goldington Green, England

[73] Assignee: Andrew Hydraulics International Limited, Bedford, England

[21] Appl. No.: 770,910

[22] Filed: Feb. 22, 1977

[30] Foreign Application Priority Data

Feb. 24, 1976 [GB] United Kingdom ..... 7322/76

[51] Int. Cl.[2] ..... B21D 7/00

[52] U.S. Cl. ..... 72/36; 29/237; 72/402; 72/453.03

[58] Field of Search ..... 72/402, 32, 36, 461, 72/453.03; 29/237

[56] References Cited

U.S. PATENT DOCUMENTS

| | | | |
|---|---|---|---|
| 1,876,950 | 9/1932 | Jaques | 72/32 |
| 3,805,580 | 4/1974 | Leiker | 72/402 |
| 3,977,065 | 8/1976 | Johnson | 29/237 |
| 4,014,202 | 3/1977 | Van Allen | 72/402 |

*Primary Examiner*—C.W. Lanham
*Assistant Examiner*—Gene P. Crosby
*Attorney, Agent, or Firm*—Cooper, Dunham, Clark, Griffin & Moran

[57] ABSTRACT

There is disclosed a device for crimping couplings to the ends of hydraulic hoses in which a plurality of die means are located around an axis, camming means is provided and is arranged to cause the die means to move radially inwardly towards the axis when the die means and camming means are moved axially relative to each other, and a hydraulic actuator is provided for causing that relative axial movement. When a coupling is inserted between the die means, operation of the hydraulic actuator causes the die means to move inwardly and thereby compress or crimp the coupling. The hydraulic actuator has an annular hydraulic fluid chamber to which pressure is applied to operate the actuator. Further features are that adjusting means is provided, for pre-setting the outside diameter to which the device will crimp a coupling, the adjusting means being coaxial with the device for increased accuracy, and having a construction which involves no projecting parts, so as to avoid damage. Means is also provided which prevents the device being operated further than a pre-set crimped diameter, so as to prevent an operator from overcrimping a coupling once the device has been properly pre-set.

10 Claims, 5 Drawing Figures

DEVICE FOR CRIMPING TUBULAR ELEMENTS

FIELD OF THE INVENTION

This invention relates to devices for crimping or swaging fittings onto members such as pipes and tubes. Although it is normally a pipe or a tube to which a fitting is applied by the use of such device, in principle the member to which a fitting is applied need not be hollow, nor cylindrical. The devices with which the invention is concerned will be referred to as crimping devices throughout this specification.

BACKGROUND OF THE INVENTION

A common use for crimping devices is to apply couplings to the ends of hydraulic hoses. A common form of coupling consists of a tubular body portion surrounded by a tubular shell portion, with an annular space between them. The end of a hose is pushed over the body portion into the space between it and the shell portion, and then the shell portion is crimped radially inwards to squeeze the end of the hose tightly between the shell portion and the body portion, thereby firmly securing the coupling to the hose.

British patent specification No. 962,094 and Canadian patent specification No. 896,222 disclose prior crimping devices which have been used for this purpose. In both those devices, a set of dies arranged around an axis are located within a crimping member which has a conical tapering inner surface. The outer surfaces of the dies lie against the inner conical surface of the crimping member. In each case an ordinary cylindrical hydraulic ram is employed to produce relative axial movement between the dies and the crimping member such that the dies are forced by the conical surface on the crimping member to move towards each other, thereby crimping a hose coupling located between the dies. In British specification No. 962,094 the dies are axially fixed and the crimping member is driven relative to them by the hydraulic ram. In Canadian specification No. 896,222 the crimping member is fixed and the dies are driven axially relative to it by the ram. In practice, it is important that at the end of a crimping operation the outside of the crimped article should have been brought to a predetermined desired outside diameter. In the British and Canadian specifications referred to above, a pair of gauging members are fixed respectively relative to the crimping ring and relative to the dies. During a crimping operation, the operator of the device has to judge by eye when these two gauging members become in line with each other, and to stop operating the device at that moment. One of the gauging members has to be preset, before crimping begins, so as to ensure that a predetermined outside diameter will have been reached when the two gauging members come into line with each other.

Devices such as those just referred to have various disadvantages.

Firstly, it is typically necessary to apply an axial force of up to 30 tons to effect a crimping operation. Using cylindrical rams as in the prior art, this has frequently required a hydraulic operating pressure of up to 10,000 psi. To achieve the required force with a lower operating pressure involves various design problems and tends to result in a device which is too bulky. The use of such a high pressure means that sealing problems are proportionately great, and a source of such a high pressure must be provided.

Secondly, the gauging members are located well off the central axis of the crimping device and for that reason its accuracy is adversely affected by any misalignment or distortion of the components of the device which may occur when it is being operated.

Thirdly, the gauging elements are such that it is not easy to preset them by eye, they rely upon the operator perceiving that the gauging elements have come into line with each other and stopping the operation of the device, in order to crimp down to a predetermined outside diameter, which is not reliable, and there is the construction which involves protruding parts which are relatively easily damaged.

SUMMARY OF THE INVENTION

In the present invention, the first of these difficulties is alleviated by providing a crimping device with a hydraulic actuator in which the hydraulic fluid chamber is of annular form. Additionally, it then becomes possible to make the device open through its centre, which has a further benefit which will be described.

The second problem is alleviated by providing adjusting means, or gauging means, which is co-axial with the device. The adjusting means is in the form of a screw-headed member co-axial with the device and relatively large in proportion to the device, so that it is easy to set. Neither does it protrude and therefore is not easy to damage. This feature therefore partly alleviates the third problem.

The remainder of the third problem is alleviated by including means which provides a positive end-stop position beyond which the hydraulic actuator cannot cause further relative movement between the dies and the crimping ring, the adjusting means being arranged to adjust the radial spacing which will exist between the dies or die-holders when the positive end-stop position has been reached. Accordingly, once the adjusting means has been set so as to provide a given spacing between the dies when at the end-stop position, then every time the device is operated it will, provided it is fully operated to the end-stop position, necessarily crimp the article being crimped to the same outside diameter, without the need for any judgement or co-ordination by the operator.

Normally, the device will be provided with die holders, and interchangeable sets of dies of different sizes may then be fitted to the die holders. Alternatively, though in fact it would be disadvantageous, fixed dies may be employed.

The adjusting means may be an adjusting member mounted on a thread co-axial with said axis, the member having a relatively large diameter angular scale thereon which co-operates with an index, so that when the adjusting member is rotated a relatively large movement of the scale relative to the index will occur for a small axial movement of the adjusting member, whereby the end-stop position of the device, and hence the final crimping diameter when the device is operated, can be accurately set by eye.

To further facilitate initial setting of the device, a second scale may be provided, extending in the axial direction and co-operating with the adjusting member, so that as the adjusting member moves axially, a portion thereof or a part attached thereto can move along the axial scale. In this case, the axial scale acts as a coarse setting scale and the angular scale acts as a fine setting scale, as will be more evident from the detailed description which follows.

Further, a device in accordance with the invention is preferably constructed with an opening extending completely through it in the axial direction, and between the dies or die holders, so that for example two hoses arranged end to end can be passed completely through the centre of the device and a suitable coupling can be crimped to the abutting ends of both hoses by the device, so as to join the hoses together.

The camming means for causing radial inward movement of the dies may be in the form of a ring with an internal camming surface, which ring encircles the die holders or dies. It is preferably then that the annular hydraulic chamber should encircle the ring. This has the result that in operation the large radial outward forces applied by the dies or die holders to the inside of the ring are counterbalanced by the radially inward forces applied to the ring by the hydraulic fluid in the ram chamber, and consequently the ring itself may be of relatively light construction since it does not have to carry the "bursting" stresses applied to it by the dies or die holders.

BRIEF DESCRIPTION OF THE DRAWINGS

In order that the invention may be more clearly understood, a preferred embodiment thereof will now be described, by way of example, with reference to the accompanying drawings, in which.

DESCRIPTION OF PREFERRED EMBODIMENT

Figure 1:
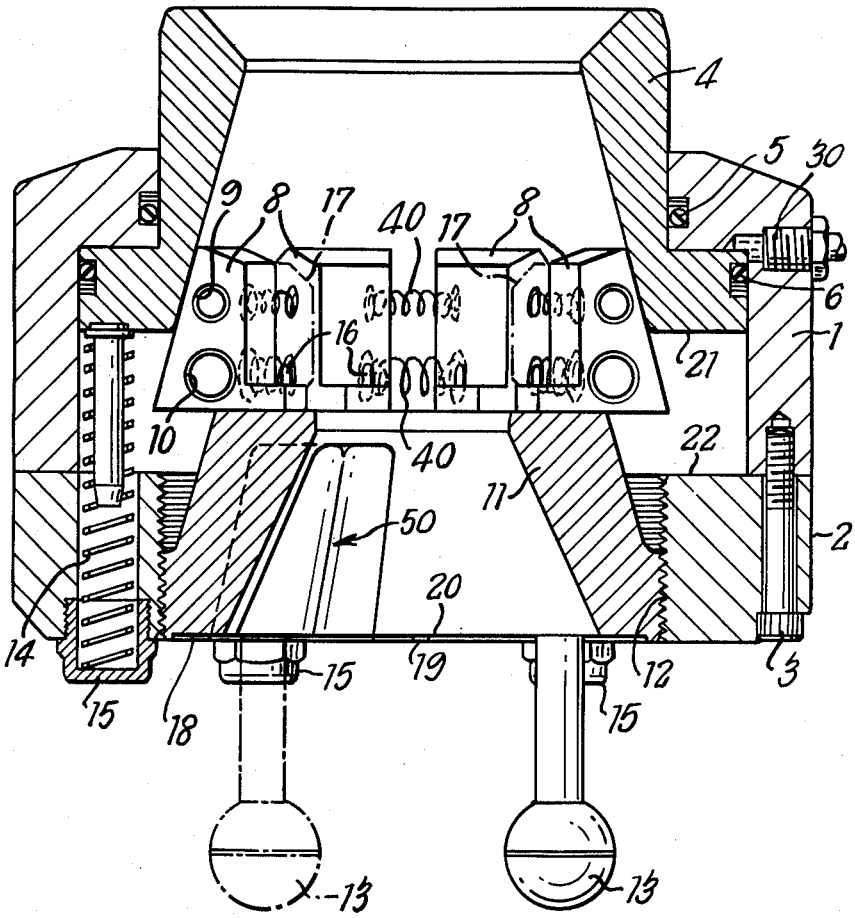
FIG. 1 is a longitudinal cross-section through a crimping device in accordance with the invention, in its starting position when adjusted to crimp down to a relatively large diameter.

The device is generally of annular form and symmetrical about its axis and has an outer casing comprising two parts 1 and 2 fixed together by means of a plurality of bolts 3 distributed around the periphery of the device.

Camming means in the form of a crimping ring 4 is slidable axially relative to the casing and hydraulic seals 5 and 6 are positioned at two points between the crimping ring 4 and the casing part 1 so as to prevent leakage of hydraulic fluid out of an annular hydraulic ram chamber 7 which lies between these two parts.

A plurality of die holders 8 are angularly spaced around the inside of the crimping ring 4, and they are maintained in contact with its inner surface by means of small coil springs 40 of which two are fitted between each two adjacent die holders, with their ends received in respective blind bores 9 and 10 in the sides of the die holders.

The die holders 8 are supported on the upper (as viewed in FIGS. 1 to 4) surface of a generally annular die base 11 which also forms an adjusting member by virtue of the fact that it is threadedly mounted in a central aperture 12 in the casing part 2. A pair of diametrically opposed handles 13 are fixed to the lower surface of the die base 11 to enable it to be manually rotated for adjustment purposes.

Figure 2:
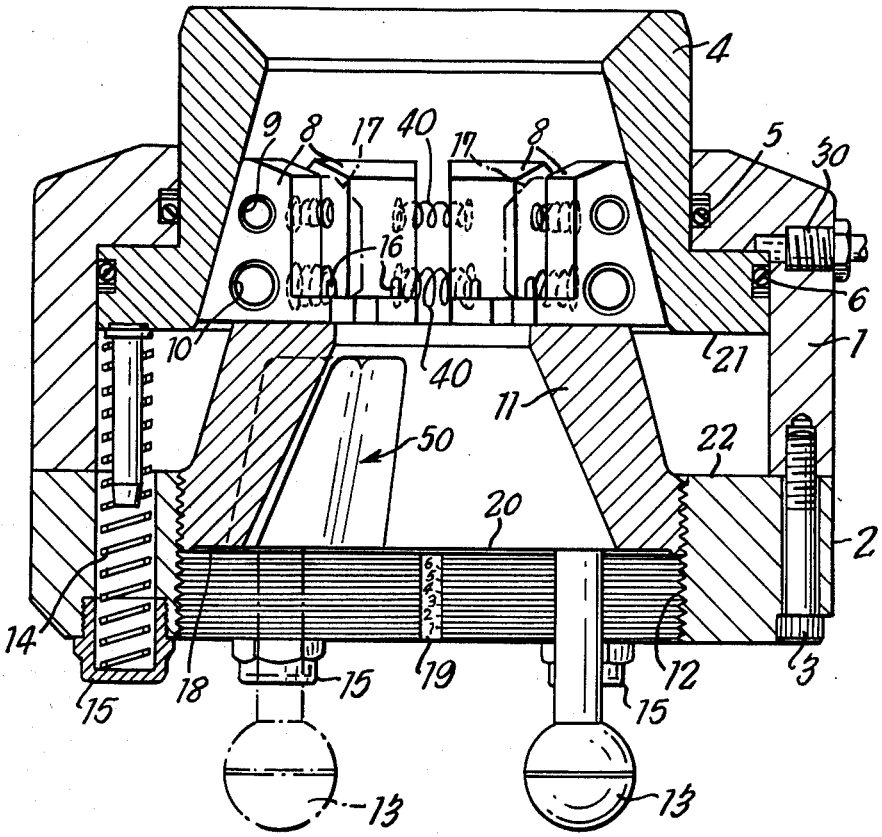
FIG. 2 corresponds with FIG. 1, but shows the device when adjusted to crimp down to a minimum diameter.
Figure 3:
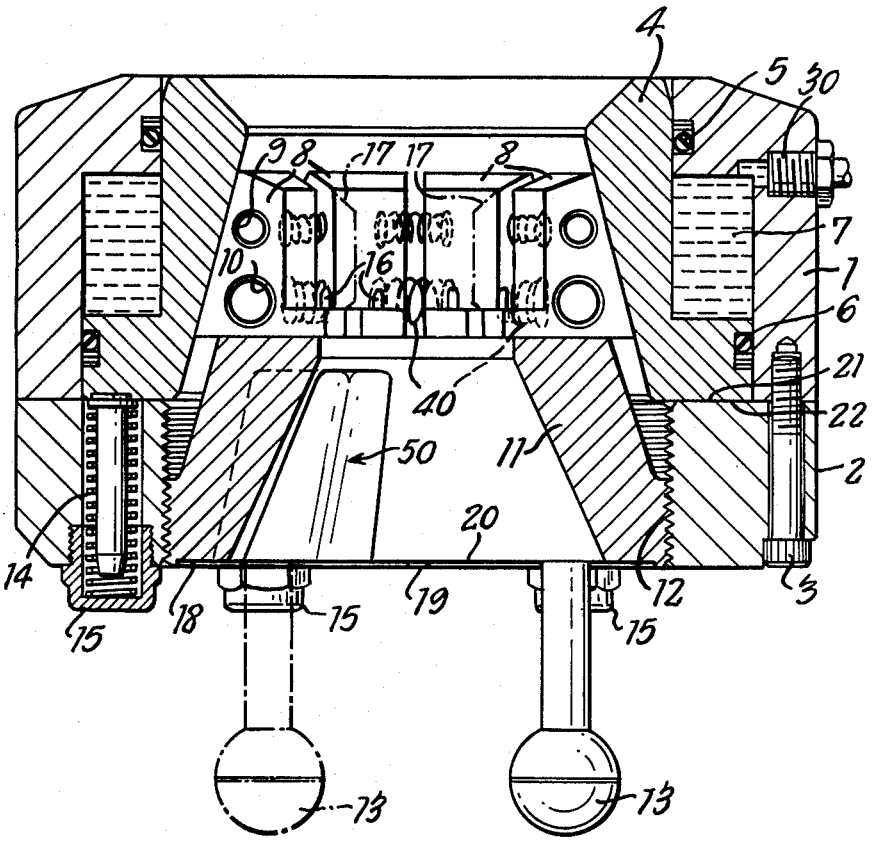
FIG. 3 is a longitudinal cross-section of the device when it has been hydraulically operated from the FIG. 1 starting position to complete a crimping operation, and has reached its end-stop position.
Figure 4:
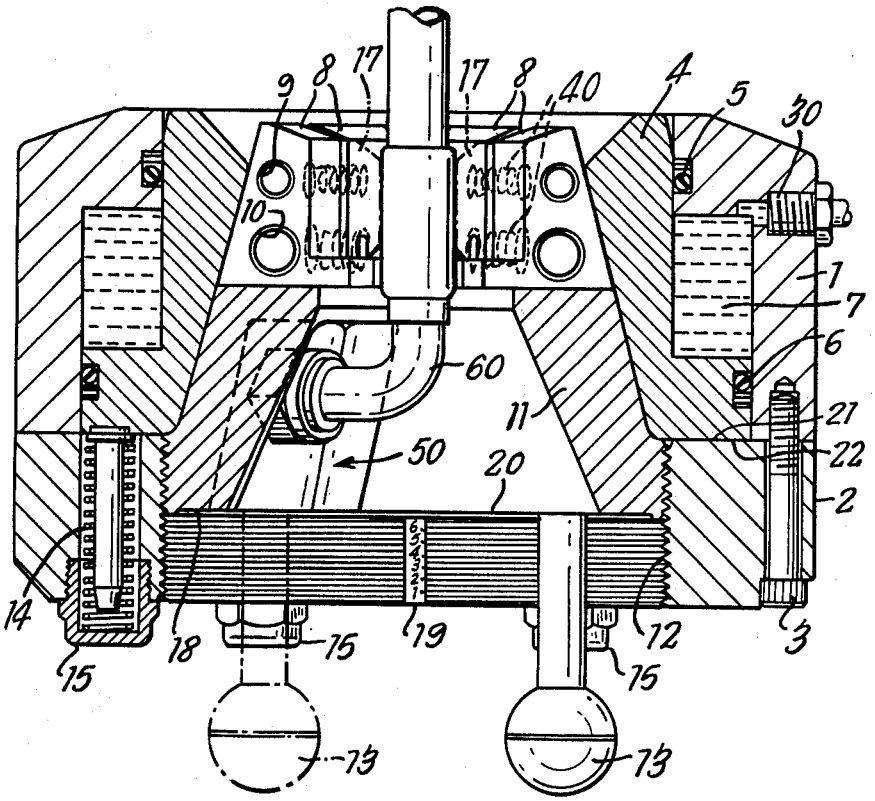
FIG. 4 corresponds with FIG. 3, but shows the device after completion of crimping starting from the FIG. 2 position.
Figure 5:
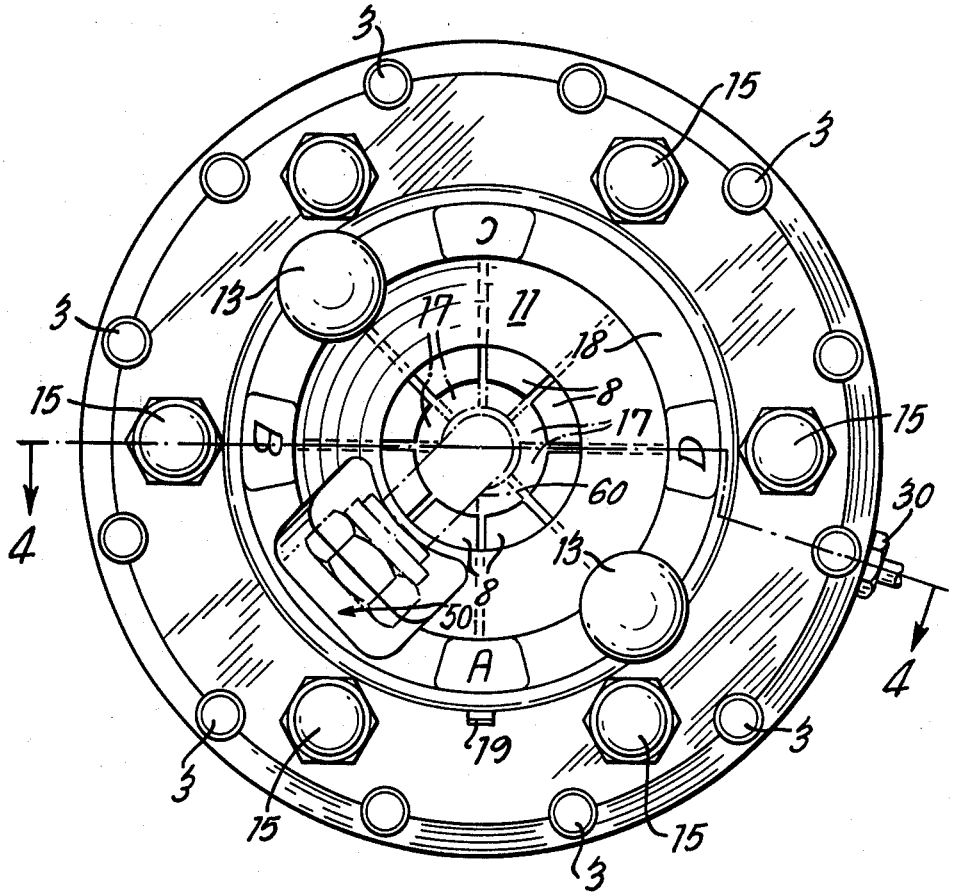
FIG. 5 is a view of the device from below when in the position of FIG. 4, the line 4—4 being the line on which the cross-section of FIG. 4 is taken.

A plurality of biassing springs 14 are distributed around the periphery of the device, in bores in the casing part 2, where they are retained by means of caps 15, and springs 14 bear on the lower surface of the crimping ring 4 and bias it upwardly from the position shown in FIGS. 3 and 4 towards the position shown in FIGS. 1 and 2, so as to return the device to its starting position after each crimping operation.

Each of the die holders 8 is provided with a peg 16. Indicated in broken lines are dies 17 provided with sockets which enable them to sit on the pegs 16, and thereby be retained on the die holders. Sets of dies of different sizes may be provided so as to enable the device to have different crimping ranges.

The lower surface 18 of the die base 11 is a flat annular surface and is provided with scale markings, for example, markings A, B, C and D which are spaced 90° apart from each other about the central axis of the device. A narrow flat 19 is cut into the internal threads on the casing part 2, parallel with the central axis and this forms an index which co-operates with the markings on the surface 18. Additionally, the flat 19 is provided with further scale markings "1", "2", etc. Preferably one of these latter markings is provided for each thread pitch. These markings cooperate with the lower edge 20 of the die base 11, which discloses them one at a time as it is screwed further into the device by rotating it using handles 13.

In one practical embodiment, which is approximately 12 inches in diameter, the pitch of the thread is ⅛ inch. For each full turn of the die base 11 a further one of the numbers marked on the flat 19 is disclosed by the edge 20. Also, for each 90° rotation of the die base 11, for example, from a position where the letter A on surface 18 is aligned with the flat 19 to a position where the letter B on surface 18 is aligned with the flat 19, represents a 1/32 inch axial movement of the die base 11, as compared with the ⅛ inch axial movement which is indicated by the disclosure of a further one of the numerals on the flat 19.

It can thus be seen that the annular scale forms a fine adjustment scale and the linear scale on flat 19 forms a coarse adjustment scale, and employing this system it is possible to define various axial positions of the die base 11, for the purposes of an operator, by a set of corresponding scale readings such as 1A, 1B, 1C, 1D, 2A etc.

It will be evident that as the die base 11 is adjusted axially, for example from the position shown in FIG. 1 to the position shown in FIG. 2, so the die holders 8 are forced by the conical internal surface on crimping ring 4 to move radially towards each other. Once they have been set to a predetermined starting position by rotating the die base 11, the article to be crimped, for example a coupling on the end of a hose, is inserted through the upper end of crimping ring 4 until it lies between the opposed faces of the dies 17. Hydraulic fluid is then pumped into the annular chamber 7 through an inlet/-outlet port 30 and this drives the crimping ring 4 downwards, so that the conical internal caming face thereof causes the die holders and dies to be driven radially inwardly across the upper surface of the die base 11, thereby squeezing the coupling onto the hose.

The surfaces 21 and 22 on the crimping ring and the casing part 2, respectively, together provide an end-stop position so that eventually, as shown in FIGS. 3 and 4, they abut together and prevent further movement of the device by the hydraulic ram. Clearly it is not possible to over-shoot the end-stop position and therefore further crimping cannot occur once this position has been reached, and the outer diameter of the crimped article must therefore correspond with the initial setting of the die base 11.

FIGS. 1 and 3 show how a maximum final crimped diameter is achieved by setting the die base 11 initially at an extreme screwed-out position whereas FIGS. 2 and 4 show how a minimum final crimped diameter is achieved by initially setting the die base 11 at a maximum screwed-in position.

After a crimping operation the pressure applied to inlet/outlet port 30 is relieved and the springs 14 drive the crimping ring 4 back to its starting position, causing hydraulic fluid to be expelled through inlet/outlet port 30. The arrangements for applying and relieving hydraulic pressure at port 30 can be conventional.

It can be seen that the adjusting mechanism is concentric with the axis of the device and therefore problems which can occur with off-centre setting systems do not arise. Also, the adjusting system does not involve any projecting parts and therefore is not liable to damage.

The device is very simple to manufacture and its arrangement enables the end-surfaces of the hydraulic chamber to have a sufficient area to give the necessary operating force when employing a hydraulic source at only about 3,000 psi, without making the device unnecessarily bulky. Consequently, the device can then be powered by a lower-duty and less expensive hydraulic pressure system. Because it can operate from a lower pressure than crimping devices employing a central cylindrical ram, the sealing problems are much reduced and the reliability of the device is improved.

It can be seen that the device is open right through its centre so that it can be employed to crimp a coupling onto the abutting ends of two pipes to join them together. Additionally, it can be employed to crimp one end of an elbow fitting onto the end of a hose, which has not normally been possible with portable crimping devices, and to facilitate this a recess 50 may be machined in the internal wall of the die base 11 to accommodate the other end of the elbow fitting (shown in broken lines at 60) when it is being crimped onto the hose.

It can also be seen, e.g., from FIG. 3, that the hydraulic fluid in the chamber 7 is positioned radially outwardly of the camming surface of a crimping ring 4. Thus the radially outward forces exerted by the die holders 8 against the ring 4 are opposed by radially inward hydraulic pressure in the chamber 7.

I claim:

1. A crimping device comprising a plurality of die means disposed around an axis, camming means disposed radially outside said die means relative to said axis, said camming means being formed such that axial relative movement between said camming means and said die means causes the camming means to drive the die means towards said axis, and a hydraulic actuator operatively associated with said die means and with said camming means for imposing said axial relative movement, said hydraulic actuator having therein an annular hydraulic chanber co-axial with said axis and expandible in said axial direction by hydraulic pressure to cause said axial relative movement, and wherein said camming means is an annular camming member having a radially inner surface portion formed as a camming surface, and having a radially outer surface portion which defines a radially inner surface of said hydraulic chamber of said actuator, said radially inner and radially outer surface portions of the camming member being directly opposite each other in the radial direction, whereby radially outward force of the die means on said radially inner surface is opposed by radially inward hydraulic pressure on said radially outer surface.

2. A crimping device as claimed in claim 1, wherein said annular camming member comprises a radially outwardly extending annular portion which defines a first annular end wall of said hydraulic chamber; and comprising an annular outer part having a radially inner surface which defines a radially outer wall of said hydraulic chamber and an annular inner surface which defines a second annular end wall of said hydraulic chamber, said annular camming member being slidable within and relative to said annular outer member as said hydraulic chamber expands and contacts axially.

3. A crimping device as claimed in claim 1, which has an opening extending through it, between the die means, in said axial direction.

4. A crimping device as claimed in claim 1, comprising means providing a positive end-stop position beyond which the hydraulic actuator cannot cause further said axial relative movement, and means for adjusting the radial spacing which will exist between the die means when the positive end-stop position has been reached following operation of the hydraulic actuator.

5. A crimping device as claimed in claim 4, wherein said adjusting means comprises an adjusting member mounted on a thread co-axial with said axis, and having a relatively large diameter angular scale thereon, and an index which co-operates with said scale, whereby when said adjusting member is rotated a relatively large movement of said scale relative to said index occurs for a relatively small axial movement of the adjusting member.

6. A crimping device as claimed in claim 5, wherein said adjusting means further comprises a second scale, said second scale extending in the axial direction for indicating the position of the adjusting member in said axial direction.

7. A crimping device as claimed in claim 4, wherein said adjusting means comprises an annular adjusting member mounted on a thread co-axial with said axis, said annular adjusting member having an annular axially facing end, said end supporting said die means within said camming means, whereby rotation of the annular adjusting member on its thread adjusts the axial position of the die means in said camming member.

8. A crimping device as claimed in claim 7, wherein said hydraulic actuator comprises an annular part which is outside and axially slidable relative to said camming member, said outer part and camming member defining said annular hydraulic chamber between them, the thread on which the adjusting member is mounted being fixedly located relative to said outer part.

9. A crimping device comprising a plurality of die means disposed round an axis, camming means disposed radially outside said die means relative to said axis, said camming means being formed such that axial relative movement between said camming means and said die means causes the camming means to drive the die means towards said axis, and a hydraulic actuator operatively associated with said die means and with said camming means for imposing said axial relative movement, said hydraulic actuator having therein an annular hydraulic chamber co-axial with said axis and expandible in said axial direction by hydraulic pressure to cause said axial relative movement, including means providing a positive end-stop position beyond which the hydraulic actuator cannot cause further said axial relative movement, and means for adjusting the radial spacing which will exist between the die means when the positive end-stop position has been reached following operation of the hydraulic actuator, wherein said adjusting means comprises an adjusting member mounted on a thread co-axial with said axis, and having a relatively large diameter angular scale thereon, and an index which co-operates with said scale, whereby when said adjusting member is rotated a relatively large movement of said scale relative to said index occurs for a relatively small axial movement of the adjusting member.

10. A crimping device as claimed in claim 9, wherein said adjusting means further comprises a second scale, said second scale extending in the axial direction for indicating the position of the adjusting member in said axial direction.

* * * * *